US008691021B2

(12) United States Patent
Hesterberg et al.

(10) Patent No.: US 8,691,021 B2
(45) Date of Patent: Apr. 8, 2014

(54) WATER-BEARING HOUSEHOLD APPLIANCE

(75) Inventors: Bernd Hesterberg, Heidenheim (DE); Karlheinz Rehm, Dischingen (DE); Michael Georg Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 204 days.

(21) Appl. No.: 13/382,528

(22) PCT Filed: Jul. 5, 2010

(86) PCT No.: PCT/EP2010/059520

§ 371 (c)(1), (2), (4) Date: Jan. 6, 2012

(87) PCT Pub. No.: WO2011/006785

PCT Pub. Date: Jan. 20, 2011

(65) Prior Publication Data

US 2012/0111372 A1 May 10, 2012

(30) Foreign Application Priority Data

Jul. 14, 2009 (DE) ..... 10 2009 027 690

(51) Int. Cl.

*A47L 15/02* (2006.01)
*A47L 15/00* (2006.01)
*A47L 15/42* (2006.01)

(52) U.S. Cl.

CPC ..... *A47L 15/001* (2013.01); *A47L 15/0049* (2013.01); *A47L 15/421* (2013.01); *A47L 15/4244* (2013.01)

USPC ..... 134/18; 134/25.2

(58) Field of Classification Search

CPC ..... A47L 2401/09; A47L 2401/08; A47L 15/001; A47L 15/0049; A47L 15/421; A47L 15/4244

USPC ..... 134/25.2, 56 D, 57 D; 417/26, 42

See application file for complete search history.

(56) References Cited

U.S. PATENT DOCUMENTS 6,007,640 A * 12/1999 Neff et al. ..... 134/18
7,225,056 B2 5/2007 Bolduan et al.

(Continued)

FOREIGN PATENT DOCUMENTS

CN 2469883 Y 1/2002
CN 1883363 A 12/2006

(Continued)

OTHER PUBLICATIONS

Machine Translation of DE 10 2007 014 386.*

(Continued)

*Primary Examiner* — Michael Barr
*Assistant Examiner* — Caitlin N Dunlap
(74) *Attorney, Agent, or Firm* — James E. Howard; Andre Pallapies

(57) ABSTRACT

A water-bearing household appliance to which fluid can be supplied during at least one filling step includes at least one drain pump for conveying fluid out of the water-bearing household appliance; and an overfill protection facility to prevent an excessive water level in the water-bearing household appliance. The overfill protection facility is configured to capture at least one operating parameter of the drain pump and after the filling step, in the presence of a malfunction of the drain pump that can be derived from the at least one operating parameter, to prevent execution of a further filling step.

25 Claims, 1 Drawing Sheet

(56) References Cited

U.S. PATENT DOCUMENTS

| | | | | |
|---|---|---|---|---|
| 2004/0200512 | A1* | 10/2004 | Clouser et al. | 134/57 D |
| 2007/0163626 | A1* | 7/2007 | Klein | 134/56 D |

FOREIGN PATENT DOCUMENTS

| | | | |
|---|---|---|---|
| DE | 102006052891 | A1 | 5/2008 |
| DE | 102007014386 | A1 | 10/2008 |
| EP | 0263550 | A1 | 4/1988 |
| GB | 925262 | | 5/1963 |
| JP | 2001346748 | A | 12/2001 |

OTHER PUBLICATIONS

Machine Translation of DE 10 2006 052 891.*
International Search Report PCT/EP2010/059520.
Decision on Granting a Patent for Invention RU 2012100392/12 dated Apr. 16, 2013.
National Search Report CN 2010800314935 dated Oct. 14, 2013.

* cited by examiner

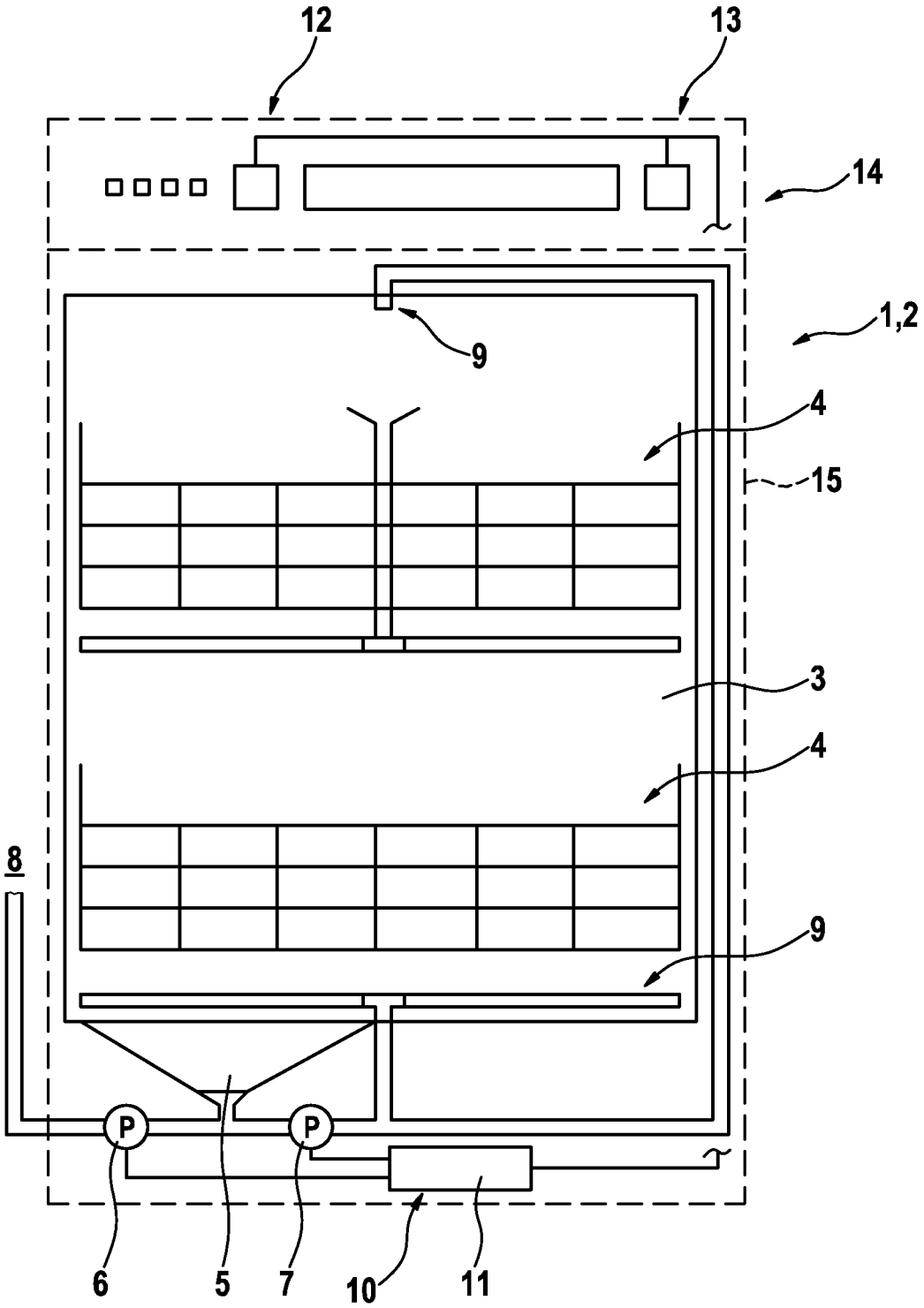
12
13
14
1,2
9
4
15
3
4
8
9
P
P
6
5
7
10
11

WATER-BEARING HOUSEHOLD APPLIANCE

BACKGROUND OF THE INVENTION

The invention relates to a water-bearing household appliance.

Water-bearing household appliances, e.g. dishwashers, are supplied with the fluid required for operation of the household appliance during a filling step. In this process the fluid is supplied in particular to a work region of the household appliance, for example a wash container of a dishwasher. At least one drain pump is also provided, which can be used to pump the fluid back out of the water-bearing household appliance again. To prevent too high a water level in the household appliance causing water to overflow and water damage thus to occur in the environment of the household appliance, the household appliance has the overfill protection facility. This prevents the too high water level occurring. For example the overfill protection facility can have a bottom trough, in which a water level sensor is disposed. Then if water escapes out of the work region of the household appliance, it runs into the bottom trough first and is collected there. When the water in the bottom trough reaches a certain level, the water level sensor is activated and thereby signals to a controller of the household appliance that water is escaping or the water level is too high. The overfill protection facility can then respond to this information, for example by preventing the further supply of water to the household appliance and/or indicating to the user that there is an error. This procedure is disadvantageous in that the water level sensor is only activated once water has already escaped from the work region of the household appliance and run into the bottom trough.

BRIEF SUMMARY OF THE INVENTION

The object of the invention is therefore to provide a water-bearing household appliance, in which the escape of water from the work region of the household appliance—for example into the bottom trough—is prevented.

According to the invention this is achieved with a water-bearing household appliance having the features of claim 21. Advantageous embodiments will emerge from the subclaims individually or in combination. Provision is made here for the overfill protection facility to be configured to capture at least one operating parameter of the drain pump and after the filling step, if a malfunction of the drain pump that can be derived from the at least one operating parameter is present, prevents the performance of a further filling step. The household appliance therefore has at least one pump, which is configured as a drain pump to convey fluid out of the water-bearing household appliance. Similarly fluid, in particular water, can be supplied to the household appliance in at least one filling step. In the process the function of the drain pump is to be monitored and a further filling step of the household appliance is to be prevented, once a malfunction of the drain pump is ascertained. This means that no further fluid can get into the household appliance, once the malfunction of the drain pump has been ascertained. Compared with the household appliances known from the prior art this has the advantage that the further filling step is already prevented before the too high water level is reached or water has escaped out of the work region of the household appliance and not just after water has already escaped into the bottom trough. The too high water level is already effectively prevented before its occurrence by preventing the further filling step. The too high water level here is defined in such a manner that it is present as soon as fluid escapes from the household appliance into an environment of the household appliance, in other words for example when the bottom trough of the household appliance overflows or earlier when fluid escapes out of the work region. The inventive configuration of the water-bearing household appliance allows a too high water level to be identified well before its occurrence, which is not possible with the household appliances known from the prior art. On the one hand this prevents the unnecessary further filling step and it also avoids water getting into a collection apparatus of the household appliance, for example the bottom trough, and from there possibly into the environment. In order to be able to ascertain the malfunction of the drain pump, the overfill protection facility is provided, which captures the at least one operating parameter of the drain pump. Provision is therefore made for the overfill protection facility to determine the operating parameter in particular continuously and thus be able to ascertain the malfunction. The overfill protection facility can also be provided in addition to an already present overfill protection unit. The household appliance can therefore also have a bottom trough with a water level determination facility, for example a water level sensor. Provision can however also be made just to use the overfill protection facility to prevent the too high water level, in order to prevent an escape of fluid into the environment of the household appliance. Alternatively or additionally it is also possible to use the overfill protection facility to prevent the operation of a sensing valve, waste water pump and/or circulating pump, as soon as the malfunction occurs. The sensing valve is configured to convey water into the household appliance. The waste water pump can pump waste water out of the household appliance and thus convey it out of there. The circulating pump is provided to circulate the water within the household appliance. The water or fluid here can also contain and/or comprise any added agents, such as cleaning agents and/or detergents.

In one development of the invention the overfill protection facility prevents the performance of the further filling step when the water-bearing household appliance is restarted. When it is restarted, it may be the case, after the starting or switching on of the household appliance, that no malfunction of the drain pump has yet occurred. The performance of the further filling step should nevertheless be prevented. Therefore the presence of the malfunction must also be known after the restarting of the water-bearing household appliance. This may be the case for example if a persistent error state is set, as soon as the malfunction of the drain pump is present. This means that the error state is also known after the switching off and restarting of the household appliance, allowing the performance of the further filling step to be prevented.

In one development of the invention the overfill protection facility is configured to compare the captured operating parameters with stored setpoint values. The overfill protection facility therefore captures the operating parameters of the drain pump and compares them with the setpoint values. The setpoint values are saved or stored in the overfill protection facility. If, when comparing the operating parameters with the setpoint values, a difference is ascertained, which is greater than a set maximum difference, the overfill protection facility can ascertain the presence of the malfunction. The performance of the further filling step can then be prevented.

In one development of the invention the overfill protection facility is configured to capture a power consumption of an electric motor driving the drain pump as an operating parameter. The power consumption of the electric motor is therefore to be determined, preferably as a function of time, and used to monitor the function of the drain pump. A drop in the power consumption of the electric motor here can for example mean that the drain pump connected to the electric motor is idling, in other words no more fluid is being conveyed, from which it can be concluded that there is no fluid present in the household appliance. In contrast too high a power consumption can mean for example that the drain pump is blocked and therefore water is not being pumped. In the latter instance a malfunction of the drain pump is present, so the further filling step is prevented. The power consumption of the electric motor can also be monitored as a function of time. This means that the power consumption profile over time is considered in order to identify the malfunction of the drain pump. Alternatively or additionally the power consumption integral can also be evaluated over time, so that for example the drain pump is monitored by considering the total quantity of power consumed since the drain pump was started up.

In one development the drain pump can be driven by an electronically commutated electric motor. The drain pump is connected in a torque-resistant manner to the electric motor and driven by it. The electric motor is electronically commutated, therefore has a controller/regulator for example, by means of which the commutation is performed. Electronically commutated means that a power flux passes from one branch to another, so that a circulating magnetic field is generated, which causes the electric motor to rotate. Alternatively commutation can also be performed mechanically, in other words for example by means of carbon brush and collector.

In one development of the invention the overfill protection facility is configured to capture a commutation of the electric motor as an operating parameter. To monitor the drain pump it is also possible to monitor the commutation of the electric motor. It can thus be ascertained for example whether the electric motor and therefore the drain pump are rotating or blocked. It is also possible to determine a current speed of the electric motor and therefore of the drain pump by monitoring the commutation. It is possible to conclude a current output of the drain pump based on this speed. A steep drop in speed may mean that the drain pump is sluggish or blocked and therefore a malfunction of the drain pump is present. A high speed or an increase in speed in contrast may mean that there is no more water or fluid present in the household appliance. The performance of the further filling step is also to be prevented here in the event of the malfunction.

In one development of the invention the overfill protection facility is connected to display means, which can be used to indicate the malfunction to a user. The malfunction of the drain pump is to be indicated to the user of the water-bearing household appliance. This allows the user to respond appropriately to the malfunction of the drain pump, for example by notifying a maintenance service or taking the necessary actions. These may involve cleaning the drain pump for example.

In one development of the invention the water-bearing household appliance is set up so that the drain pump can be brought into operation after the water-bearing household appliance has been started. The drain pump can be activated after the household appliance has been switched on. This can take place for example after the switching on or starting of the household appliance, in order first to monitor the function of the drain pump. If a malfunction of the drain pump is ascertained in this process, the further filling step can be prevented. The starting of the drain pump can also serve to determine whether there is fluid present in the household appliance. Thus after the household appliance has been started, a defined initial state is already established, specifically a low water level. This is achieved by conveying fluid out of the water-bearing household appliance by means of the drain pump.

In one development of the invention the water-bearing household appliance is set up so that after the water-bearing household appliance has been started, an error state query can be performed by the overfill protection facility. Immediately after the water-bearing household appliance has been started, provision is made for the error state query. The error state results for example from a previous malfunction of the drain pump. It is therefore not necessary to check or monitor the function of the drain pump after every switching on or starting operation, if the error state is already set, because it is already known that the malfunction of the drain pump is present. It is therefore possible to respond appropriately to the malfunction of the drain pump and prevent the further filling step of the water-bearing household appliance. The error state is set when the drain pump malfunctions. A set error state therefore prevents the further filling step, in particular immediately after the household appliance has been started. This means that as soon as the malfunction of the drain pump has once been ascertained, the drain pump no longer has to be monitored, as the set error state prevents the further filling step. The error state is particularly advantageously persistent. This means that it is set permanently, in other words it is not deleted, for example when the household appliance is switched off. Thus a persistent error state once set remains set even after the switching off and restarting of the household appliance. If the error state is already set after the household appliance has been started, the function of the drain pump does not have to be monitored but the further filling step can be directly prevented. Of course it is also possible to continue to monitor the function of the drain pump in this instance too. The persistent error state can be reset manually in an unset state.

In one development of the invention the overfill protection facility is connected to a water level determination facility, in particular a water level sensor. The water level determination facility serves to determine a water level, for example in the bottom trough of the water-bearing household appliance. It can thus be ascertained whether the water level of the bottom trough means that it is likely that water will escape from the household appliance. Provision is made here for the overfill protection facility to be connected to the water level determination facility and for the overfill protection facility to be able to prevent the further filling step as soon as the too high water level is ascertained by means of the water level determination facility. If electrical facilities are disposed in the bottom trough, it is recommended that the supply of water should be interrupted based on the water level information determined by the water level determination facility, before the water reaches the electrical facilities. This can be achieved advantageously using a water level sensor, which is disposed below the electrical facilities and thus signals that the water supply must be interrupted to prevent water reaching the electrical facilities. The water level determination facility is provided in addition to the overfill protection facility and/or configured by this. The water level determination facility is disposed for example in the bottom trough of the household appliance. Water escaping from the work region of the household appliance, which would otherwise run out of the household appliance, for example as a consequence of the malfunction of the drain pump, is collected in the bottom trough. The bottom trough therefore serves initially to hold a certain quantity of water, before water can escape from the household appliance. To this end the bottom trough is configured as an outflow protection. The bottom trough is generally provided in a low position in the household appliance. The bottom trough preferably forms the lowest point of the household appliance at least in parts.

The invention also relates to a method for operating a water-bearing household appliance, in particular a dishwasher, preferably according to the abovementioned embodiments, in the course of which fluid is supplied at least at times during a filling step and fluid is conveyed out of the water-bearing household appliance at least at times during a further step by operation of a drain pump, with an overfill protection facility preventing too high a water level in the water-bearing household appliance. Provision is made here, after the filling step, for the overfill protection facility to capture at least one operating parameter of the drain pump at least at times during the further step and, if a malfunction of the drain pump that can be derived from the at least one operating parameter is present, to prevent the performance of a further filling step. The household appliance therefore comprises the overfill protection facility, which prevents too high a water level in the household appliance. This is achieved by the overfill protection facility monitoring the function of the drain pump. If the malfunction of the drain pump is ascertained in this process, the further filling step of the household appliance is prevented. The household appliance can be both a dishwasher and a washing machine. The function of the drain pump is monitored in this process as described above by means of the overfill protection facility and the further filling step of the dishwasher or washing machine is optionally prevented.

BRIEF DESCRIPTION OF THE DRAWINGS

The invention is described in more detail below based on the exemplary embodiments illustrated in the drawing, without the invention being thus restricted. In the drawing the single FIGURE shows a schematic diagram of a water-bearing household appliance.

DETAILED DESCRIPTION OF EXEMPLARY EMBODIMENTS OF THE PRESENT INVENTION

The FIGURE shows a schematic diagram of a water-bearing household appliance 1, which is configured as a dishwasher 2. The dishwasher 2 has a work region 3, in which items to be cleaned or washed (not shown) can be disposed. The items here are positioned in at least one rack 4, which can be pulled out forwards for example from the work region, in other words from the plane of the drawing. The work region 3 is also referred to as a wash container. A sump 5 is provided at the bottom of the work region 3, to collect water introduced into the work region 3 or the wash liquor. Connected to the sump 5 for fluid flow purposes are a drain pump 6 and a circulating pump 7. Fluid can be conveyed from the sump 5 in the direction of a waste water connection 8 by means of the drain pump 6. The drain pump 6 can also be used to pump fluid out of the sump 5 or the work region 3, whereby the drain pump 6 also serves as a discharge pump. The circulating pump 7 can be used to supply fluid from the sump to at least one supply facility 9. The fluid is conducted back into the work region 3 of the dishwasher 2 by way of the supply facility 9. Both the drain pump 6 and the circulating pump 7 are connected to a control facility 10, which also comprises an overfill protection facility 11. The overfill protection facility 11 monitors at least one operating parameter of the drain pump 6 and, if there is a malfunction of the drain pump 6 present, prevents the performance of a further filling step of the dishwasher 2, in particular by deactivating the circulating pump 7 or preventing further water being supplied to the household appliance 1. As indicated in the FIGURE, the control facility 10 is connected to display means 12 or operating elements 13 of the dishwasher 2. The operating elements 13 can comprise for example a start switch, which can be used to start a wash cycle of the dishwasher 2 or a work cycle of the household appliance 1. Display means 12 and operating elements 13 are provided in an operating region 14, which is provided on a housing 15 simply outlined in the FIGURE. When the overfill protection facility 11 ascertains the malfunction of the drain pump 6, this can be indicated to a user of the dishwasher 2 by means of the display means 12. The user can then initiate appropriate measures. When a malfunction is ascertained, the start switch, i.e. the operating element 13, is also blocked or ineffective. This means that a wash cycle of the dishwasher 2 cannot be started using the operating element 13 but is prevented by the control facility 10 or the overfill protection facility 11. A further fill step, in other words a further introduction of fluid into the dishwasher 2, can therefore only be performed once the malfunction of the drain pump 6 has been eliminated. This prevents fluid escaping from the dishwasher 2.

By monitoring the function of the drain pump 6 it is also possible to monitor whether there is water present in the household appliance 1. If the function of the drain pump 6 is monitored before water or fluid is supplied to the household appliance 1, it can be ascertained whether fluid is present in the household appliance 1. This water can originate for example from a previous operating cycle of the household appliance 1. It can thus be checked for example (immediately) after the household appliance 1 has been started, whether fluid is present. This procedure can however also be used after water has been removed from the household appliance 1, to ascertain whether the water has been removed completely from the household appliance 1. Removal can take place for example by pumping out using the drain pump 6. However it is also possible for the water to run out, in other words without the use of the drain pump 6. Monitoring the function of the drain pump 6 therefore allows the current water level of the household appliance 1 to be ascertained in so far as it is determined whether water is present therein. This provides a defined initial position for the at least one filling step. Provision can be made for example to prevent the further filling step, if it is ascertained that water is still present in the household appliance 1 after pumping out using the drain pump 6, in other words that it was not/could not be pumped out completely. This can effectively prevent the occurrence of too high a water level.

The drain pump 6 here can be monitored by means of the overfill protection facility 11 or a motor controller of an electric motor used to drive the drain pump 6. The monitoring or capturing of the at least one operating parameter of the drain pump 6 by the overfill protection facility 11 can be performed before and/or during and/or after a program run of the household appliance 1. The program run is for example the program run of a wash program, in the event that the household appliance 1 is a dishwasher 2, as illustrated here. A program run therefore refers to a run through a normal work cycle of the household appliance 1. Monitoring of the function of the drain pump 6 can be performed at any time point during the program run of the household appliance 1. For example the function of the drain pump 6 can be monitored or checked before and/or during and/or after the program run. Provision can be made here, if a malfunction of the drain pump 6 is ascertained before the program run of the household appliance 1, for the program run not to be started. If the malfunction of the drain pump 6 is diagnosed during the program run, the program run can be terminated. Provision can be made, if the malfunction of the drain pump 6 is ascertained after the program run of the household appliance 1, for a persistent error state to be set. In this way the further filling step or starting of the program run can also be prevented after the switching off or switching back on/restarting of the household appliance 1.

The invention claimed is:

1. A water-bearing household appliance to which fluid can be supplied during at least one filling step, said water-bearing household appliance comprising:

at least one drain pump to perform a pumping out operation to remove fluid from the water-bearing household appliance; and an overfill protection facility to prevent an excessive water level in the water-bearing household appliance, said overfill protection facility configured to capture at least one operating parameter of the drain pump, said overfill protection facility configured to determine, base on at least one captured operating parameter, whether fluid is present in the water-bearing household appliance after the pumping out operation is complete, wherein said overfill protection facility is configured to prevent execution of a further filling step when the overfill protection facility determines that fluid is present in the water-bearing household appliance.

2. The water-bearing household appliance of claim 1, constructed in the form of a dishwasher.

3. The water-bearing household appliance of claim 1, wherein the overfill protection facility prevents execution of the further filling step when the water-bearing household appliance is restarted.

4. The water-bearing household appliance of claim 1, wherein the overfill protection facility is configured to compare the captured operating parameter with a stored setpoint value.

5. The water-bearing household appliance of claim 1, wherein the overfill protection facility is configured to capture a power consumption of an electric motor driving the drain pump as the at least one operating parameter.

6. The water-bearing household appliance of claim 1, further comprising an electronically commutated electric motor for driving the drain pump.

7. The water-bearing household appliance of claim 6, wherein the overfill protection facility is configured to capture a commutation of the electric motor as the at least one operating parameter.

8. The water-bearing household appliance of claim 1, further comprising a display unit to indicate a malfunction to the user, said overfill protection facility being connected to the display unit to indicate as a malfunction fluid being present in the water-bearing household appliance after the pumping out operation.

9. The water-bearing household appliance of claim 1, wherein the drain pump is activated after the water-bearing household appliance has been started.

10. The water-bearing household appliance of claim 1, wherein the overfill protection facility is configured to execute an error state query after the water-bearing household appliance has been started.

11. The water-bearing household appliance of claim 1, further comprising a water level determination facility connected to the overfill protection facility.

12. The water-bearing household appliance of claim 11, wherein the water level determination facility is a water level sensor.

13. A method for operating a water-bearing household appliance, comprising:

supplying fluid at least at times during a filling step;

operating a drain pump to perform a pumping out operation to remove fluid from the water-bearing household appliance at least at times during a further step;

operating an overfill protection facility to prevent an excessive water level in the water-bearing household appliance;

capturing at least one operating parameter of the drain pump at least at times during the further step and after the filling step said overfill protection facility determining, based on the at least one captured operating parameter, whether fluid is present in the water-bearing household appliance after a pumping out operation; and preventing execution of a further filling step when the overfill protection facility determines that fluid is present in the water-bearing household appliance.

14. The method of claim 13, wherein the water-bearing household appliance is a dishwasher.

15. The method of claim 13, wherein execution of the further filling step is prevented by the overfill protection facility when the water-bearing household appliance is restarted.

16. The method of claim 13, wherein the overfill protection facility compares the captured operating parameter with a stored setpoint value.

17. The method of claim 13, wherein the overfill protection facility captures a power consumption of an electric motor driving the drain pump as the at least one operating parameter.

18. The method of claim 13, wherein the drain pump is driven by an electronically commutated electric motor.

19. The method of claim 13, wherein the overfill protection facility captures a commutation of the electric motor as the at least one operating parameter.

20. The method of claim 13, further comprising indicating a malfunction to a user by a display unit connected to the overfill protection facility when the overfill protection facility determines that fluid is present in the water-bearing household appliance.

21. The method of claim 13, wherein the step of operating the drain pump is performed when the water-bearing household appliance is started.

22. The method of claim 13, further comprising executing an error state query by the overfill protection facility after the water-bearing household appliance has been started.

23. The method of claim 13, wherein the overfill protection facility is connected to a water level determination facility.

24. The method of claim 13, wherein the water level determination facility is a water level sensor.

25. A water-bearing household appliance, comprising:

a wash container to which fluid can be supplied during at least one filling step;

at least one drain pump to remove fluid from the water-bearing household appliance;

a circulating pump to draw fluid from the wash container and reintroduce the fluid to the wash container via at least one supply facility; and a control facility to prevent an excessive water level in the water-bearing household appliance, said control facility configured to capture at least one operating parameter of the drain pump, said control facility configured to determine, based on the at least one captured operating parameter, whether a malfunction has occurred, wherein the control facility is configured to deactivate the circulating pump to prevent further fluid from being supplied to the wash container when the control facility determines that a malfunction has occurred;

wherein the drain pump is configured to perform a pumping out operation to remove fluid from the water-bearing household appliance, said control facility being configured to determine, based on the at least one captured operating parameter, whether fluid is present in the water-bearing household appliance after a pumping out operation, and wherein said control facility determines that a malfunction has occurred when the control facility determines that fluid is present in the water-bearing household appliance.

* * * * *